United States Patent [19]

Clarke et al.

[11] 4,188,159

[45] Feb. 12, 1980

[54] MAINTAINING THE SHAPE OF HOLES

[76] Inventors: Stanley W. Clarke; Angus J. Clarke, both of 2 High St., Weston Underwood, Olney, Buckinghamshire, England

[21] Appl. No.: 894,533

[22] Filed: Apr. 7, 1978

[30] Foreign Application Priority Data

Apr. 13, 1977 [GB] United Kingdom ..... 15345/77

[51] Int. Cl.[2] ..... E21D 11/00

[52] U.S. Cl. ..... 405/282

[58] Field of Search ..... 61/41 A, 35; 27/29; 52/128, 124; 405/282, 283, 272

[56] References Cited

U.S. PATENT DOCUMENTS 3,357,193 12/1967 Fitzgibbon, Jr. ..... 61/35

FOREIGN PATENT DOCUMENTS 2161250 8/1973 Fed. Rep. of Germany ..... 405/282
391586 9/1965 Switzerland ..... 405/282
511467 8/1939 United Kingdom ..... 61/41 A
1249914 10/1971 United Kingdom ..... 405/282

*Primary Examiner*—Mervin Stein
*Attorney, Agent, or Firm*—Lawrence E. Laubscher

[57] ABSTRACT

In order to maintain the shape of a hole, such as a grave, dug in the ground, an inflatable bag is lowered into the hole and then inflated to a low pressure so as substantially to fill the hole, thus maintaining the sides of the hole against subsidence and also largely preventing water seeping into the hole. A protective cover is then placed over the hole and means are provided for anchoring this cover to the bag itself, which is wedged against the sides of the hole.

4 Claims, 4 Drawing Figures

MAINTAINING THE SHAPE OF HOLES

BACKGROUND OF THE INVENTION

This invention relates to a method of maintaining the shape of a grave or other hole dug in the ground, and to an inflatable bag for use in the method.

A freshly dug grave is liable to lose its shape, in the course of time, owing to subsidence, and is also liable to at least partially fill with water. The shape of the grave then has to be restored, and/or the grave emptied, before it can be used. These are particular problems where, for economy, several graves are dug at the same time, using a digging machine, and the graves left for extended periods of time until they are required for use.

SUMMARY OF THE INVENTION

In accordance with this invention, there is provided a method of maintaining the shape of a grave or other hole dug in the ground, comprising the steps of lowering a bag into the grave or hole and inflating the bag to substantially fill the grave or hole.

The inflated bag not only maintains the sides of the grave or hole against subsidence but also largely prevents water from seeping into the grave or hole.

BRIEF DESCRIPTION OF THE FIGURES

An embodiment of this invention will now be described, by way of example only, with reference to the accompanying drawings in which.

DETAILED DESCRIPTION

Figure 1:
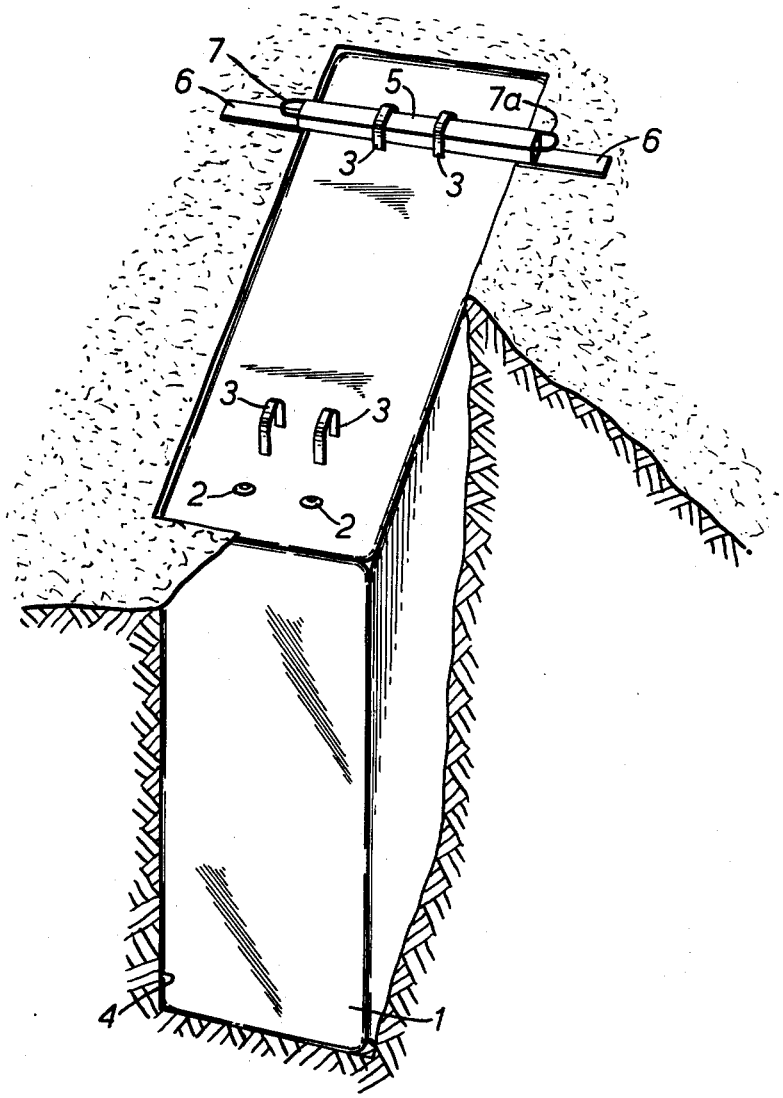
FIG. 1 is a perspective, cut-away view of the inflatable bag when lowered into a hole and inflated.

The inflatable bag 1 is formed from sections of flexible, air-impervious sheet material secured together, the seams being effected with adhesive. Suitable material comprises synthetic plastics, especially Hypalon or Neoprene which are found to be resistant to acid which the bag is likely to encounter. A suitable construction of sheet material comprises two layers of sheet with a layer of reinforcing netting interposed, the three layers being bonded together.

The bag is approximately rectangular in natural shape and a typical size is 7 feet long, 2 feet 10 inches wide and 7 feet high.

The top is provided with two inlet/outlet valves 2 adjacent one end, and also with two canvas loops 3 towards each end, although instead a single such loop may be provided towards each end.

In use, the bag, in deflated condition, is lowered into the grave 4 or other hole which is to be maintained and it is then inflated by connecting a low-pressure air blower to the two valves 2. A convenient blower is a 110 volt industrial blower marketed by Wolf in the United Kingdom, having a motor driving a separate impeller. A pressure of 1 lb/sq. inch is satisfactory and can be achieved in about 2 minutes. Not only is the bag inflated sufficiently to support the sides of the grave or other hole, but also the bag, as result of its inflation, is wedged firmly between the opposite sides of the grave.

Figure 2:
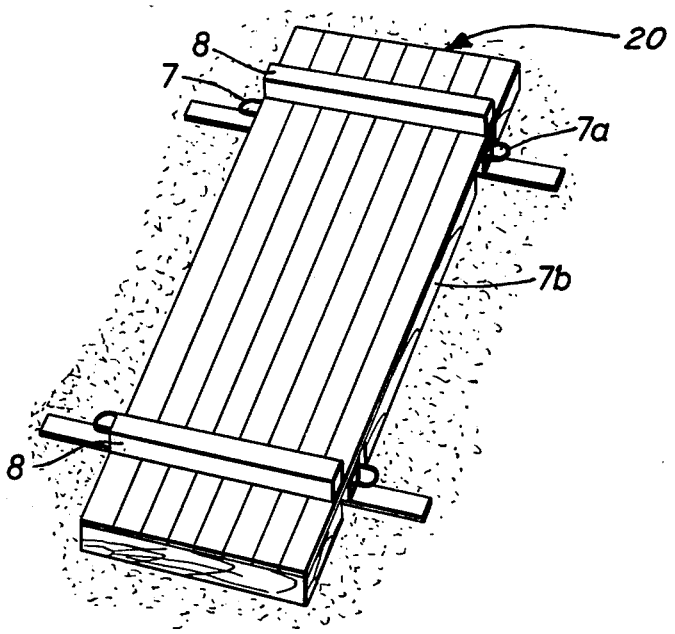
FIG. 2 is a perspective view of a protective cover placed over the hole after the bag has been inflated therein.

Accordingly, it provides a firm anchorage for the protective cover 20 shown in FIG. 2.

Once the bag is inflated and the blower is disconnected from the valves 2, a first metal bar 5 is passed through a first pair of the canvas loops 3 as shown, and a second, identical bar (not shown) is passed through the other pair of canvas loops 3. The bar 5 comprises a length of rectangular-section tube, slightly longer than the width of the grave, having an extension of metal strip 6 welded to its lower side at opposite ends. The bar is placed so that these extensions sit on the flat ground adjacent the opposite sides of the hole, as shown. A metal loop 7, *7a* is welded to each end of the bar, at its upper surface.

Next, the protective cover 20 is placed over the grave. This may comprise any appropriate rigid sheet which is strong enough to support the weight of people standing on it. In the example shown, it comprises a number of lengths of wooden boards arranged side-by-side and secured together by two cross-battens 8 on the upper side of the cover. The spacing between these two battens is just greater than the spacing between the two pairs of canvas loops 3 and the protective cover is placed over the grave so that both bars 5 traverse the cover underneath the space between the two battens 8, each bar 5 being close to the adjacent batten.

Figure 3:
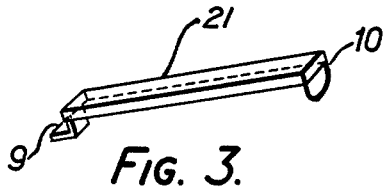
FIG. 3 shows a locking bar for use in securing the protective cover in position.

The protective cover is locked in position with the aid of two locking bars, one of which is shown in FIG. 3. This comprises a metal bar 21 having a depending hook 9 at one end and a depending loop 10 welded to the other end. One locking bar is provided for each of the bars 5.

The hook 9 of each locking bar is engaged within the hook 7 of the respective bar 5 and the locking bar is placed across the top of the protective cover and its hook 10 is engaged around the hook *7a*: a padlock is then engaged through hook *7a* to lock the bars together. Then, the protective cover cannot be lifted, nor can it be moved horizontally, the battens 8 preventing longitudinal movement.

When the grave or other hole is required for use, the protective cover is removed and the bag is deflated by coupling the suction port of the blower to both valves 2. Deflation takes typically 3½ minutes.

Preferably, before the bag is lowered into the grave for inflation, the grave is lined with protective sheeting, for example plastics such as polythene. This protects the bag against puncturing by scuffing, or the penetration by sharp stones or the like projecting from the sides or bottom of the grave.

It will be noted that the cover is provided with edging pieces *7b* around its periphery to the depth of the bars 5, so that the edging pieces sit on the flat ground around the hole so that nothing can be thrust between the cover and the ground to damage the air bag.

Figure 4:
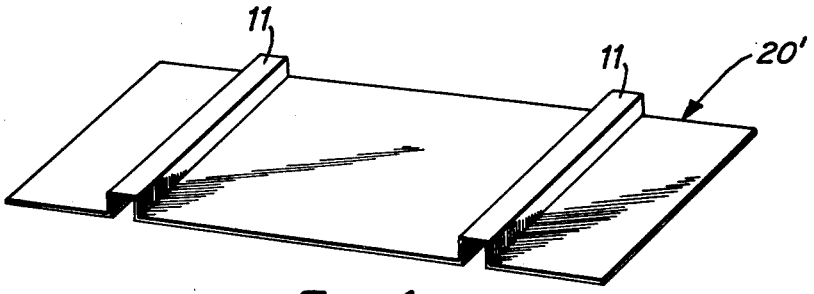
FIG. 4 shows an alternative construction of the protective cover.

Referring to FIG. 4, there is shown an alternative protective cover 20' which is made from light alloy sheeting pressed to provide two channels 11 to fit over the bars 5, the edges of the cover sitting on the flat ground around the hole and the locking bars of FIG. 3 being used in the same manner as previously described.

What we claim is:

1. A method for maintaining the shape of a hole dug in the ground, such as a grave, comprising the steps of (a) introducing a normally-deflated inflatable support bag into the hole, said support bag having a configuration generally conforming to the configuration of the hole and including on its upper surface (1) at least one pair of laterally spaced integral connecting loops, and (2) at least one valve means;

(b) inflating said support bag through said valve means whereby said support bag initially assumes the configuration of the hole and subsequently presses in contiguous relation against the side walls of the hole to thereby become fixed therein;

(c) introducing at least one pair of connecting bar members through said pair of connecting loops, respectively, said connecting bar members extending completely across said support bag upper surface, the end portions of said connecting bars resting on the ground adjacent the hole;

(d) positioning a rigid protective cover member over said support bag upper surface and said connecting bar members, said cover member resting on the surface of the ground surrounding the hole;

(e) positioning a pair of locking bar members over said cover member adjacent said connecting bar members; and (f) connecting the end portions of said connecting bar and locking bar members, respectively, to anchor said cover member to said support bag.

2. A method as defined in claim 1, wherein said cover member comprises wood.

3. A method for maintaining the shape of a hole dug in the ground, such as a grave, comprising the steps of (a) introducing a normally-deflated inflatable support bag into the hole, said support bag having a configuration generally conforming to the configuration of the hole and including on its upper surface (1) at least one pair of laterally spaced integral connecting loops, and (2) at least one valve means;

(b) inflating said support bag through said valve means whereby said support bag initially assumes the configuration of the hole and subsequently presses in contiguous relation against the side walls of the hole to thereby become fixed therein;

(c) positioning a rigid protective cover member over said support bag upper surface, said cover member resting on the surface of the ground surrounding the hole; and (d) connecting said protective cover member with said support bag connecting loops.

4. Apparatus for maintaining the shape of a hole dug in the ground, such as a grave, comprising (a) an inflatable support bag having an inflated configuration conforming to the configuration of the hole;

(b) valve means arranged on the upper surface of said support bag for the inflation and deflation thereof;

(c) a rigid, protective cover member arranged over said support bag upper surface when said bag is arranged in the hole in its inflated condition, said cover member resting on the ground surrounding the hole; and (d) means for connecting said cover member with said support bag, said connecting means including (1) at least one pair of laterally spaced integral connecting loops arranged on said support bag upper surface;

(2) at least one pair of connecting bar members passed through said pair of connecting loops, respectively, said connecting bar members extending completely across said support bag upper surface, the end portions of said connecting bars resting on the ground adjacent the hole;

(3) at least one pair of locking bar members arranged across the upper surface of said cover member, said locking bar members arranged adjacent and parallel with said connecting bar members; and (4) locking means for connecting the adjacent ends of said connecting bar members and locking bar members, respectively, whereby when said bag is arranged within the hole and inflated, said bag presses in contiguous relation against the side walls of the hole to thereby become fixed therein, and further whereby said cover member protects said support bag upper surface.

* * * * *